US005896009A

United States Patent [19]

Rosenwald

[11] Patent Number: 5,896,009

[45] Date of Patent: Apr. 20, 1999

[54] EXTENDING THE LIFE OF INCANDESCENT LAMPS BY POWER FACTOR MODULATION

[76] Inventor: Jeffrey A. Rosenwald, 8606 Burnt Hickory Cir., Frederick, Md. 21704

[21] Appl. No.: 08/898,281

[22] Filed: Jul. 22, 1997

[51] Int. Cl.[6] ..... H05B 37/00

[52] U.S. Cl. ..... 315/56; 315/62; 315/194

[58] Field of Search ..... 315/56, 57, 58, 315/59, 60, 61, 62, 283, 311, 247, 291, 194

[56] References Cited

U.S. PATENT DOCUMENTS

| | | | |
|---|---|---|---|
| 380,945 | 1/1888 | Shallenberger . | |
| 3,213,377 | 10/1965 | Neale | 328/155 |
| 3,868,540 | 2/1975 | Passmore et al. | 315/73 |
| 4,349,768 | 9/1982 | Miller | 315/105 |
| 4,629,943 | 12/1986 | Ponce, Jr. | 315/200 R |
| 4,988,923 | 1/1991 | Masaki | 315/277 |
| 5,012,157 | 4/1991 | Walton et al. | 315/66 |
| 5,066,892 | 11/1991 | Bouchard et al. | 315/46 |
| 5,504,394 | 4/1996 | Johnson | 315/71 |

*Primary Examiner*—Don Wong
*Assistant Examiner*—David H. Vu
*Attorney, Agent, or Firm*—Griffin, Butler, Whisenhunt & Szipl, LLP

[57] ABSTRACT

A non-saturating inductor is connected in series with the filament of an incandescent lamp and the increase in resistance of the filament with respect to the increase in temperature is utilized to dynamically modulate the power factor of the circuit during a warm-up interval immediately following lamp turn-on.

4 Claims, 1 Drawing Sheet

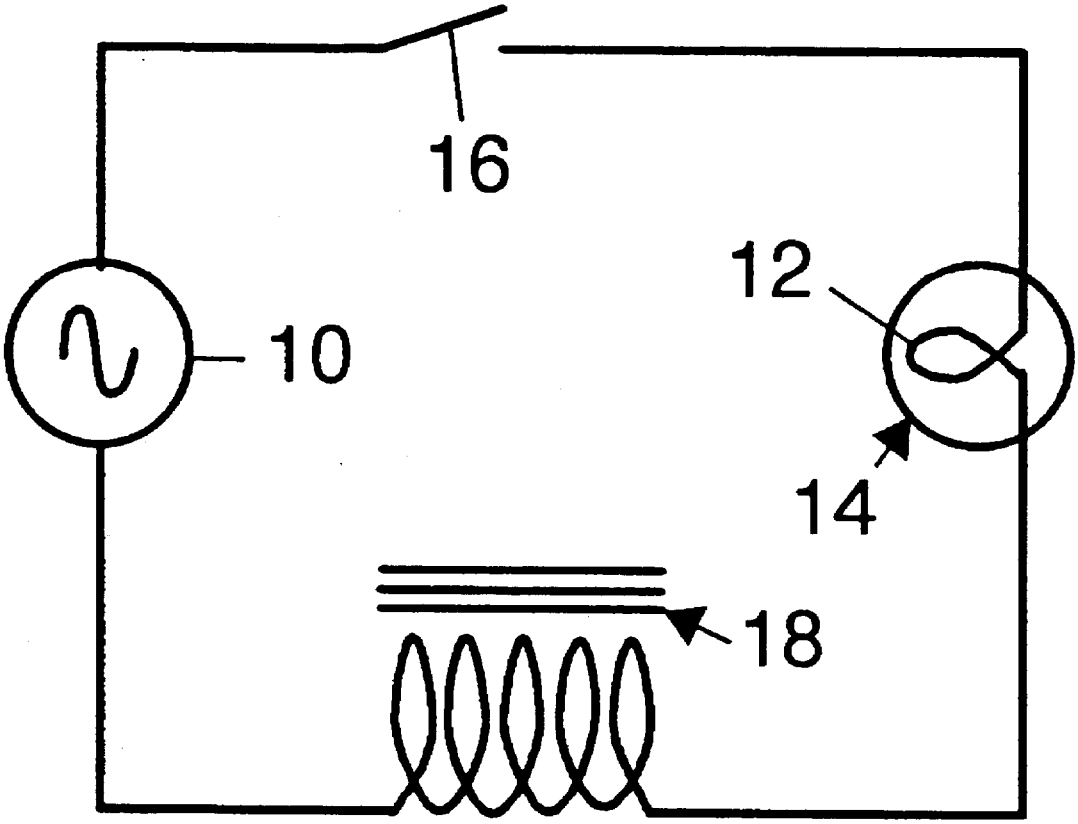
16
12
10
14
18

EXTENDING THE LIFE OF INCANDESCENT LAMPS BY POWER FACTOR MODULATION

FIELD OF THE INVENTION

The present invention relates to a method and apparatus for extending the life of an incandescent lamp or bulb by limiting the rate of increase of current flow through the lamp filament for a short interval of time after power is applied. More particularly, the invention relates to a method for extending lamp life by modulating the power applied to the filament according to the change of filament resistance with respect to temperature. A non-saturating inductor is connected in series with the lamp filament so that the power factor of the circuit is modulated according to the change in filament resistance.

BACKGROUND OF THE INVENTION

Passmore U.S. Pat. No. 3,818,540 recognizes the variable resistance behavior of tungsten filaments in lamps or bulbs and suggests that, because of low filament resistance when the filament is cold, a high current flow at turn-on time is a significant factor in the failure rate of the lamp. The patentee limits the current flow by providing a fixed resistance in series with the filament to limit current flow until after the filament has warmed up. A temperature-sensitive bimetallic switch has contacts in parallel with the resistor for shorting out the resistance when the filament has warmed up to some predetermined temperature. The arrangement provides a static control, that is, the current-limiting resistance is constant throughout the filament warm-up interval. The arrangement requires a mechanical temperature sensor which is an additional source of failure. A further disadvantage of this device is that the temperature sensor must be in close proximity to the filament and within the lamp thus requiring special lamp manufacturing procedures.

SUMMARY OF THE INVENTION

An object of the present invention is to provide a method of increasing filament life of a resistive filament in an incandescent lamp selectively connectable in a series circuit with a source of power, the method comprising modulating the power factor of the circuit according to the change of the resistance of the filament with respect to time.

Another object of the invention is to provide a method of increasing the life of an incandescent lamp having a filament with a resistance which increases as the filament temperature increases during a warm-up interval after power is applied, the method comprising placing a non-saturating inductor in a series circuit with the filament whereby the series circuit has a power factor which dynamically increases as the filament temperature increases during the warm-up interval.

A further object of the present invention is to provide an incandescent lamp having a filament with a resistance which increases as the filament temperature increases; a power source for applying an energizing current to the filament; and, an inductor connected in series with the filament, the inductor being sized to carry the energizing current without saturating and having a reactance less than the resistance of the filament at ambient temperature.

Other objects and advantages of the invention will become obvious upon consideration of the following description and the accompanying drawings.

BRIEF DESCRIPTION OF THE DRAWINGS

The single FIGURE shows an incandescent lamp and a non-saturable inductor connected in series with the filament of the lamp.

DESCRIPTION OF A PREFERRED EMBODIMENT

The single drawing FIGURE shows a power source 10 providing power to the filament 12 of an incandescent lamp or bulb 14 through a switch 16. Power source 10 provides a 60 Hz alternating current at 120 volts (RMS) as is available from electric public utilities.

The lamp 14 may be any conventional incandescent lamp but for purposes of explaining the principles of this invention it will be assumed that the lamp is a conventional 120 volt, 250 watt infrared heat lamp such as that used as a local warming device in a household bathroom. The particular lamp used in experiments was a tungsten filament lamp having a resistance, when cold, of 4.5 ohms, a resistance of 58 ohms after warm-up, and a resistance/temperature coefficient of 0.0045 Ω/°C. The warm-up interval is the interval between the time power is first applied to the filament and the time at which the filament reaches its operating or maximum resistance. The warm-up interval is about 100 ms.

Switch 16 is a conventional on-off wall or lamp switch for selectively connecting the filament 12 of lamp 14 to the power source 10.

In accordance with the present invention, an inductor 18 is connected in series with the filament 12. The inductance of inductor 18 may vary widely within certain constraints. The inductance should be small so that its reactance ($X_L = 2\pi nfL$) is less than the resistance $R_f$ of filament 12 at ambient temperature. This insures that the inductor does not substantially reduce the power expended in the lamp filament after the warm-up interval. It is essential that inductor 18 be non-saturating. That is, the inductor must have sufficient saturation current capacity so as to avoid saturation during the warm-up interval which is when the current regulation primarily takes place. In experiments using the above-described lamp 14, an 8 mH, 5 amp, iron core choke was used as the inductor 18.

The presence of inductor 18 in the circuit makes it possible to take advantage of the change in filament resistance with respect to the change in filament temperature to dynamically modulate the power factor of the impedance of the AC circuit over the warm-up interval, thereby effectively regulating the circuit power. Since the power factor of the circuit is equal to the filament resistance ($R_f$) divided by the magnitude of the circuit impedance ($|Z|$) the power factor rapidly approaches 1 as the filament resistance increases relative to the constant reactance ($X_L$) of the inductor.

Table I sets forth the values of certain circuit parameters when the lamp described above is energized and no inductor 18 is provided in the circuit. The column headed 'cold' sets forth the values at the time switch 16 is closed and the column headed 'warm' sets forth the values at 100 ms or more after the switch is closed.

TABLE I

| | WITHOUT INDUCTOR | |
|---|---|---|
| | COLD | WARM |
| $R_f$ | 4.5Ω | 58Ω |
| L | 0.0 Henry | 0.0 Henry |
| $X_L$ | $2\Pi fL = 0.0\Omega$ | $2\Pi fL = 0.0\Omega$ |
| Z | $(R_f^2 + X_L^2)^{1/2} = 4.5\Omega$ | $(R_f^2 + X_L^2)^{1/2} = 58\Omega$ |
| PF | $R/\lvert Z\rvert = 1.0$ | $R/\lvert Z\rvert = 1.0$ |
| E | 120 Volts AC RMS 60 Hz | 120 Volts AC RMS 60 Hz |
| I | E/Z = 26.6667 Amp | E/Z = 2.069 Amp |
| VA | E × I = 3200 VA | E × I = 248.2759 VA |
| P | VA × PF = 3200 Watts | VA × PF = 248.2759 Watts |

Since the filament resistance is the only resistance in the circuit at the time the switch is closed, the power factor (PF)

is 1 and the relatively low resistance of the filament is the only current-limiting impedance. Thus, a very large current (I=26.6667 amps) flows through the filament and the power (P=3200 watts) is dissipated as heat and light from the filament 12.

As the filament warms up, its resistance increases linearly with respect to temperature until it reaches 58 ohms after about 100 ms. The current flow decreases as the resistance increases so when the lamp is fully warmed up, a current of 2.0690 amps is flowing through the filament and it is dissipating 248.2759 watts of power.

Table II is similar to Table I but shows the values of circuit parameters with inductor 18 in the circuit.

TABLE II

WITH INDUCTOR

| | COLD | WARM |
|---|---|---|
| $R_f$ | 4.5Ω | 58Ω |
| L | 0.008 Henry | 0.008 Henry |
| $X_L$ | $2\Pi fL = 3.019\Omega$ | $2\Pi fL = 3.019\Omega$ |
| Z | $(R_f^2 + X_L^2)^{1/2} = 5.4172\Omega$ | $(R_f^2 + X_L^2)^{1/2} = 58.0784\Omega$ |
| PF | $R/\lvert Z\rvert = 0.8307$ | $R/\lvert Z\rvert = 0.9987$ |
| E | 120 Volts AC RMS 60 Hz | 120 Volts AC RMS 60 Hz |
| I | E/Z = 22.1518 Amp | E/Z = 2.0662 Amp |
| VA | E × I = 2658.2213 VA | E × I = 247.9409 VA |
| P | VA × PF = 2208.1690 Watts | VA × PF = 247.6064 Watts |

The impedance, and the power factor are now functions of the reactance of the inductor and the resistance of the filament. For the assumed values of the circuit components the current-limiting impedance Z is now 5.4172 ohms when the filament is cold and the power factor is now 0.8307 rather than 1. Therefore, when switch 16 is first closed a current of only 22.1518 amps flows through the circuit and the power dissipated by the filament is only 2208.1690 watts. Thus, the initial current flow through a cold filament when inductor 18 is present is only 0.8307 as great as the initial current when no inductor is present, and the power dissipated by the filament is only 0.6902 as great.

Very little power is actually dissipated in the inductor 18. The voltage drop across the inductor is opposite to the applied voltage and is proportional to the rate of change of the current in the circuit (−L(di/dt)). The inductor effectively reduces stress on the filament during periods of rapid change in current, such as during the warm-up interval, and thus contributes to protection and longer life of the filament. The presence of the inductor does not substantially change the heating/lighting capacity of the circuit after the warm-up period. This is due to the stored energy in the inductor being returned to the circuit during the decaying periods of the voltage sine wave. As shown in Tables I and II, the power after the warm-up interval is almost the same with or without the inductor: 247.6064 watts with the inductor and 248.2759 without the inductor.

From the foregoing description it is seen that the present invention provides a method and apparatus for extending the life of an incandescent lamp by dynamically regulating the power factor of the lamp circuit, the regulation being controlled by the resistance/temperature characteristic of the lamp filament. The invention may be implemented to extend the life of lamps for heating and/or lighting so long as the lamps have filaments, the resistance of which varies during a warm-up interval. All that is required is a suitable inductor. The physical size of the inductor necessary to avoid saturation precludes locating it within the envelope of a conventional lamp. Preferably, the inductor will be located within or on a fixture supporting the lamp but obviously it may be remotely located with respect to the lamp or lamp fixture.

I claim:

1. A method of increasing the life of an incandescent lamp having a filament with a resistance which increases as the filament temperature increases during a warm-up interval after an energizing current is applied, said method comprising:

placing a non-saturating inductor in a series circuit with said filament whereby said series circuit has a power factor which dynamically increases as the filament temperature increases during the warm-up interval, the inductor being sized to carry the energizing current without saturating during or after the warm-up interval, and the inductor having a reactance less than the resistance of the filament during and after the warm-up interval.

2. A method as claimed in claim 1 wherein the inductor placed in the series circuit has a reactance comprising over 50% of the total series circuit impedance at ambient temperature and less than 1% of the total series circuit impedance after said warm-up interval.

3. The combination comprising:

an incandescent lamp having a resistive filament, said filament having a resistance which increases as the filament temperature increases during a warm-up interval;

a power source for applying an energizing current to said filament; and, an inductor connected in series with said filament, said inductor being sized to carry said energizing current without saturating during or after the warm-up interval, and the inductor having a reactance less than the resistance of the filament at ambient temperature.

4. A device as claimed in claim 3 wherein the inductor has a reactance comprising over 50% of the total series circuit impedance at ambient temperature and less than 1% of the total series circuit impedance after said warm-up interval.

* * * * *